United States Patent [19]

Wrhen

[11] Patent Number: 4,487,249

[45] Date of Patent: Dec. 11, 1984

[54] METHOD AND APPARATUS FOR ADJUSTING THE SIZE OF A CONTINUOUS CASTING MOLD

[75] Inventor: Wilmer C. Wrhen, Venango County, Cranberry Township, Pa.

[73] Assignee: United States Steel Corporation, Pittsburgh, Pa.

[21] Appl. No.: 434,773

[22] Filed: Oct. 18, 1982

[51] Int. Cl.[3] ..... B22D 11/16

[52] U.S. Cl. ..... 164/452; 164/436; 164/491

[58] Field of Search ..... 164/436, 491, 452, 150, 164/154

[56] References Cited

U.S. PATENT DOCUMENTS 3,675,889 7/1972 Peck ..... 249/82
4,090,549 5/1978 Ives et al. ..... 164/451
4,124,058 11/1978 Gladwin ..... 164/436
4,124,059 11/1978 Roggo ..... 164/436

FOREIGN PATENT DOCUMENTS 2702976 7/1977 Fed. Rep. of Germany ..... 164/436

*Primary Examiner*—Kuang Y. Lin
*Assistant Examiner*—Richard K. Seidel
*Attorney, Agent, or Firm*—William F. Riesmeyer, III

[57] ABSTRACT

A continuous casting mold is adapted for measurement of the clamping force exerted on the mold sidewalls. A method of adjusting the mold size includes measuring the clamping force and adjusting it to a predetermined value, preferably a value related to the size to which the mold is adjusted. The method may also include monitoring the clamping force during casting and adjusting it so as to maintain it constant at said predetermined value.

4 Claims, 3 Drawing Figures

METHOD AND APPARATUS FOR ADJUSTING THE SIZE OF A CONTINUOUS CASTING MOLD

BACKGROUND OF THE INVENTION

The present invention relates to an improvement in continuous casting molds for measuring clamping force on the mold sidewalls, and a method of adjusting the size of such improved molds.

Continuous casting molds typically have two opposed pairs of sidewalls, one pair serving to clamp against the other, maintaining a fluid-tight joint therebetween. The clamping forces which are initially set by a workman may vary during the casting operation due to thermal loading. Also, the usual mechanical arrangements for setting clamping forces may be subject to variations caused by human error. Molds which have adjustable sidewalls are in some cases subject to having excess strain exerted on the clamping mechanism due to thermal loading. Also excessive clamping force may be applied as a safety factor when one clamping mechanism is used for all mold sizes.

It is therefore a primary object of this invention to provide an apparatus for measuring clamping force on the walls of continuous casting molds.

It is another object of this invention to provide a method for adjusting the size of continuous casting molds utilizing apparatus for measuring the clamping force exerted on the mold walls.

SUMMARY OF THE INVENTION

An improvement is provided in continuous casting molds which have two (2) pairs of opposed sidewalls, the inner surfaces of which define a cavity for at least partial solidification of molten metal therein. The mold includes means for adjustment of the relative position of the sidewalls in one of said pairs so as to selectively clamp and release opposite edges of the sidewalls in the other pair. Typically, one of the sidewalls in said first pair is stationary, the other being movable. According to this invention, means associated with the adjustment means for said first pair of sidewalls is provided for measuring the force exerted by the walls in said first pair on the opposite edges of the sidewalls in said other pair. The invention is especially applicable to molds on which means is also provided for adjustment of the spacing between the sidewalls in said other pair. Preferably, the measuring means includes a load cell. The output of the load cell may be run to an indicator or recorder, or it may be used in a computer control for regulating the adjustment means. The invention is applicable to molds having various types of adjustment means, e.g. screw drive, hydraulic back pressure, or mechanical pressure exerted from an external frame.

A method is also provided for adjusting the size of a continuous casting mold. The conventional method includes relieving clamping force exerted on the sidewalls of the mold; after relief of the clamping force, adjusting the spacing between opposed sidewalls of the mold so as to determine the size of cavity defined by said sidewalls, and re-imposing clamping force on the sidewalls of the mold. Generally, in conventional molds the spacing between two narrow sidewalls is adjusted by back and forth movement of both of the narrow sidewalls. However, for purposes of the claims it is understood that adjustment of mold size conceivably may be accomplished by movement of one, or all, or any combination of the sidewalls of the mold. The improvement of this invention includes, after re-imposing clamping force on the mold sidewalls, measuring the clamping force, and adjusting the clamping force to a predetermined value. The predetermined value of clamping force preferably is dependent on the spacing to which opposed sidewalls of the mold are adjusted. For example, the clamping force should be related to the pressure of molten metal on the mold sidewalls. It is also preferred to relieve the clamping force only partially during adjustment of the spacing of the narrow sidewalls. The force remaining when the clamping force is delivered may also be related to the adjusted size of the mold. The force method may further include monitoring the clamping force during casting of metal, and maintaining the clamping force essentially constant during casting at said predetermined value thereof. Thus, undue strain on the frame supporting the mold sidewalls, caused by thermal factors and pressure of molten metal in the mold is prevented.

DESCRIPTION OF THE PREFERRED EMBODIMENT

Figure 1:
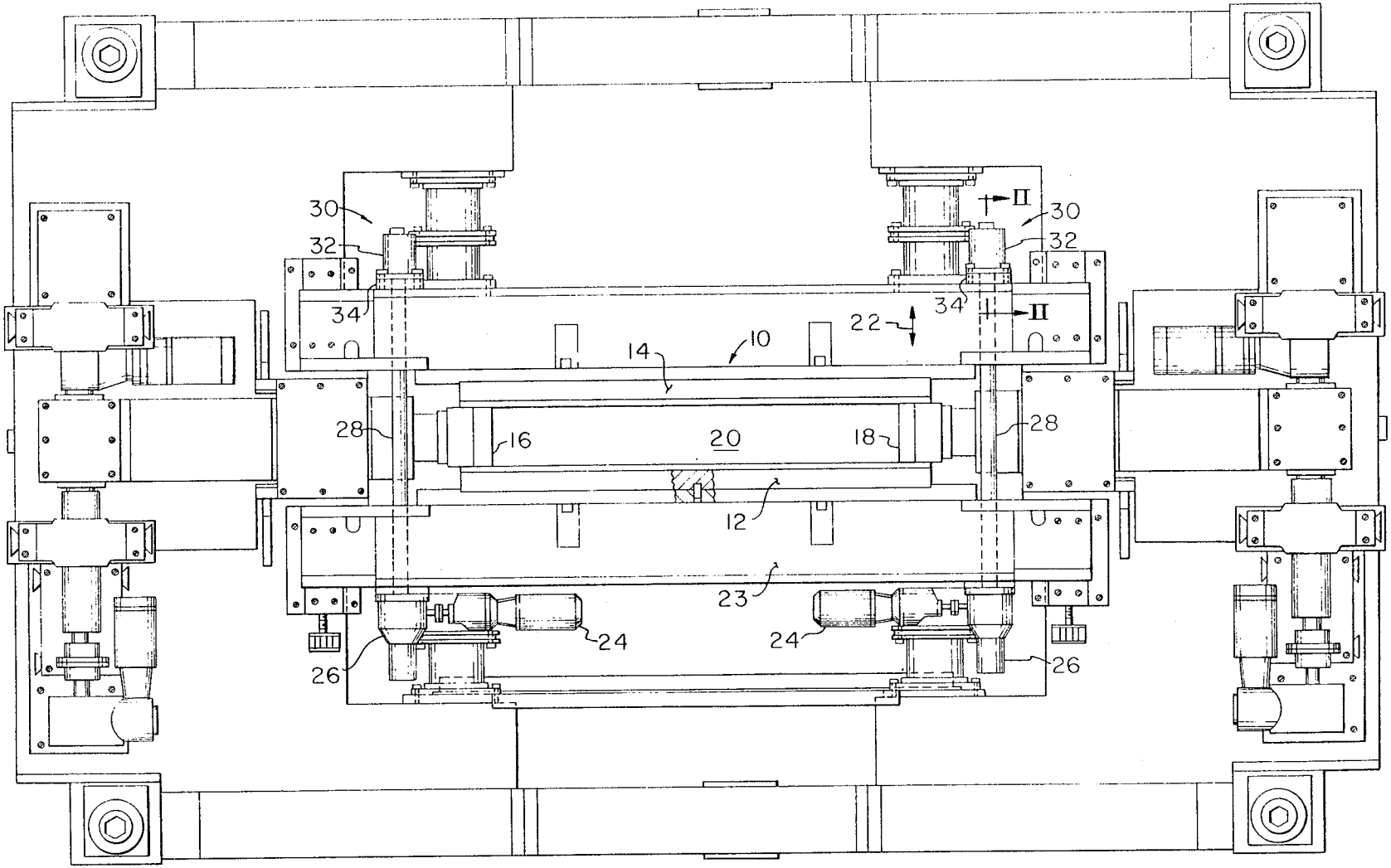
FIG. 1 is a plan view of a continuous casting mold including the apparatus of this invention.
Figure 2:
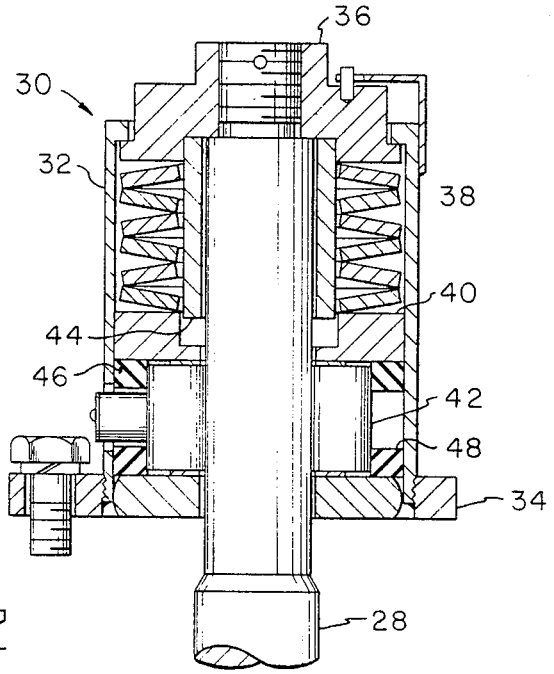
FIG. 2 is a section taken at II—II of FIG. 1.

FIG. 1 shows a conventional continuous casting mold 10 having a fixed wide side 12, adjustable wide side 14 for alternately clamping and releasing narrow sides 16, 18 which are movable back and forth for varying the width of a metal slab formed in open ended cavity 20 of the mold. Details of portions of the mold not related to the present invention will not be described since such apparatus is well known in the art. Means is provided for adjusting wide side 14 back and forth in directions illustrated by arrow 22. A pair of identical drive means are mounted on support structure 23 of fixed wide side 12. Each drive means includes gear motor 24 coupled to screwjack 26 which drives jackstem 28. A spring assembly 30 is provided for biasing wide side 14 inwardly against narrow sides 16, 18. The clamping force exerted on the narrow sides depends on the degree of compression of the spring in assembly 30. The improvement of this invention is illustrated in modifications to spring assembly 30. The assembly includes housing 32 secured to mounting plate 34 which in turn is bolted to the support structure of wide side 14. Jackstem 28 is threadably received in spring support plate 36 (FIG. 2) slidably mounted in housing 32. A belleville spring 38 mounted between plate 36 and fixed plate 40 bears against looad cell 42. A slidable shaft bearing 44 mounted on the jackstem serves to guide movement of spring 38. Rubber ring seals 46, 48 prevent dirt or foreign material from entering the housing and interfering with operation of the load cell.

In operation, motor 24 and screwjack 26 drive jackstem 28 back and forth in alternate axial rotation so as to vary the degree of compression of spring 38. Load cell 42 reads the force exerted and provides an output signal proportioned thereto. Thus, the degree of clamping force exerted by wide sides 14 on the narrow sidewalls 12 is measured and can be adjusted by control of motor 24.

Figure 3:
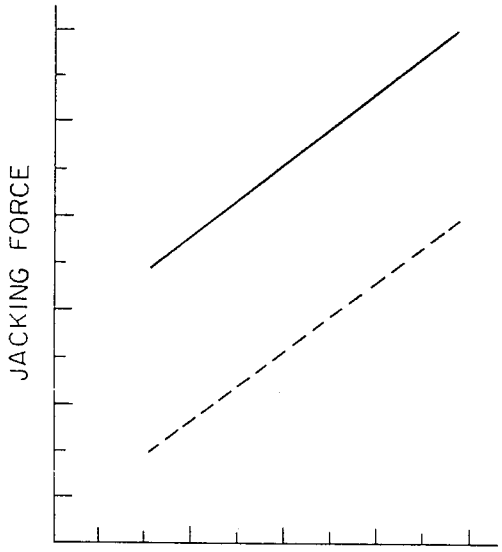
FIG. 3 is a graph schematically illustrating the relationship of clamping force to mold size.

FIG. 3 shows a graph illustrating the relationship of clamping force (solid line) to dimension of the spacing between narrow sidewalls 16, 18 of the mold illustrated in FIG. 1. The dotted line shows the degree to which clamping force preferably is relieved for adjustment of mold sizes. This also is related to the adjusted dimensions of the mold. The predetermined value of clamping is related to the pressure of molten metal in the mold. Setting the initial clamping force based on the dimensions of the casting to be produced and maintaining the force essentially constant during casting prevent undue strain on the frame and support structure of the mold.

I claim:

1. In a method of adjusting the size of a continuous casting mold, said method including relieving the clamping force exerted on the sidewalls of said mold, after relief of the clamping force, adjusting the spacing between opposed sidewalls of said mold, and reimposing the clamping force on the sidewalls of said mold, the improvement in said method which comprises:

measuring the clamping force exerted on the sidewalls of the mold during the continuous casting operation, and adjusting the clamping force imposed on the sidewalls of the mold during the continuous casting operation to a predetermined value, said value being dependent upon the spacing to which the opposed sidewalls of said mold are adjusted.

2. The method of claim 1 in which said mold includes a wide pair of opposed sidewalls and a narrow pair of opposed sidewalls, said wide sidewalls being adapted to exert a clamping force on said narrow sidewalls, said narrow sidewalls being adapted for adjusting the spacing therebetween and thus the size of casting produced in said mold.

3. The method of claim 1 wherein said predetermined value is a function of the pressure exerted by molten metal contained in said mold on the sidewalls thereof.

4. The method of claim 1 further comprising monitoring the clamping force during said continuous casting operation, and maintaining said clamping force at said predetermined value dependent upon the spacing of the opposed sidewalls of the mold.

* * * * *